US006640481B1

(12) United States Patent
Williams, Jr.

(10) Patent No.: US 6,640,481 B1
(45) Date of Patent: Nov. 4, 2003

(54) EXTERNALLY ADJUSTABLE RIFLE TELESCOPE

(76) Inventor: John B. Williams, Jr., 5900 Dale St., Buena Park, CA (US) 90621

( * ) Notice: Subject to any disclaimer, the term of this patent is extended or adjusted under 35 U.S.C. 154(b) by 0 days.

(21) Appl. No.: 10/213,314

(22) Filed: Aug. 5, 2002

(51) Int. Cl.[7] ..... F41G 1/387

(52) U.S. Cl. ..... 42/126; 42/119; 42/124; 42/125

(58) Field of Search ..... 42/119, 124, 125, 42/126, 127, 128, 136

(56) References Cited

U.S. PATENT DOCUMENTS

| | | | | | |
|---|---|---|---|---|---|
| 2,224,783 | A | * | 12/1940 | Gibbs | 42/126 |
| 2,491,431 | A | * | 12/1949 | Unertl et al. | 42/126 |
| 2,715,257 | A | * | 8/1955 | Kipp | 249/45 |
| 2,717,447 | A | * | 9/1955 | Leupold | 42/127 |
| 3,334,418 | A | * | 8/1967 | Brint | 42/125 |
| 5,784,823 | A | * | 7/1998 | Chen | 42/115 |
| 5,867,915 | A | * | 2/1999 | McMillan | 42/123 |
| 6,508,026 | B1 | * | 1/2003 | Uppiano et al. | 42/119 |

OTHER PUBLICATIONS

"Externally Adjustable Telescopic Sight (20$^{th}$ Century)" Photographic record of rifle telescopes.

* cited by examiner

*Primary Examiner*—Michael J. Carone
*Assistant Examiner*—Gabriel S. Sukman
(74) *Attorney, Agent, or Firm*—Langlotz Patent Works, Inc.; Bennet K. Langlotz

(57) ABSTRACT

A rifle telescope has a scope body having an objective end and an eyepiece end. A front mount and a rear mount are spaced apart from each other and connected to the scope body. The front mount is connected more proximate to the objective end, and the rear mount is connected more proximate to the eyepiece. The scope body is axially fixed to the front mount while being pivotally connected to the front mount. The rear mount includes an adjustable suspension operable to establish a selected vertical and horizontal position of the scope body portion received within the rear mount. The scope body may include a ball portion that interacts with a socket portion of the front mount to provide pivoting, or may include a flange that is constrained by elastomeric rings on the front mount to provide pivoting, centering, and shock absorption. The rear mount may be split in two portions to open and permit removal of the scope body. An objective lens assembly may be slidably mounted at the objective end to absorb recoil forces.

17 Claims, 5 Drawing Sheets

EXTERNALLY ADJUSTABLE RIFLE TELESCOPE

FIELD OF THE INVENTION

This invention relates to rifle telescopes, and more particularly to scopes for long distance shooting where significant elevation compensation is required.

BACKGROUND OF THE INVENTION

Optical telescopes are used as precision sighting devices for rifles and other firearms and projectile-firing devices. A rifle scope normally is adjustable in windage and elevation to align the optical axis (as indicated by crosshairs or comparable reticle) with the point of impact of a bullet at a selected distance. Conventional rifle scopes employ internal optical elements that are moved within the scope tube to shift the optical aiming point. Finely threaded adjustment knobs contact the internal elements to provide selected degrees of shift in vertical and horizontal directions. These internally adjusted scopes provide a limited angular shift of the aiming point; excessive shift leads to vignetting of the image and other unwanted aberrations. Larger scope tubes permit greater image shift amounts, but at increased cost and problematic compatibility with common scope ring mounts.

For very long range shooting, conventional rifle scopes are unable to provide adequate negative elevation angles to align with the significantly depressed point of impact of the bullet with respect to the rifle barrel axis. Prior rifle scopes have attempted to avoid the limitations of internal-adjustment by eliminating the internal adjustment optics, and steering the entire scope tube to provide a wide range of fine angular adjustments without optical limitations. Such scopes have a forward support connected to the rifle, with a hinged element on the support that receives the scope. At the rear, the scope tube passes through the bore of a block, with the contact points of adjustment knobs defining the tube's position in each axis. However, with the powerful cartridges normally employed for shooting at distances at which the elevation limitations of internally adjusted scopes are exceeded, significant recoil is developed.

Prior externally adjustable scopes accommodated recoil forces by allowing the entire scope to reciprocate axially with respect to the mounts, with springs that absorbed the recoil energy and returned the scope to the original position. This "slider" approach is complex, cumbersome, can generate alignment errors, and is believed to have been long abandoned in the market for these and other reasons. These prior scopes also suffered the disadvantage of being difficult to disassemble and maintain. In particular, the rear mount that surrounds the rear portion of the tube must be removed from the rifle to remove, service, or change the scope. This leads to a loss of "zero," which is the alignment established by the adjustment knobs.

Accordingly, there is a need for a rifle scope that provides wide ranges of elevation adjustment and convenient dismounting without the disadvantages of prior scope systems.

SUMMARY OF THE INVENTION

The present invention overcomes the limitations of the prior art by providing a rifle telescope having a scope body with an objective end and an eyepiece end. A front mount and a rear mount are spaced apart from each other and connected to the scope body. The front mount is connected more proximate to the objective end, and the rear mount is connected more proximate to the eyepiece. The scope body is axially fixed to the front mount while being pivotally connected to the front mount. The rear mount includes an adjustable suspension operable to establish a selected vertical and horizontal position of the scope body portion received within the rear mount. The scope body may include a ball portion that interacts with a socket portion of the front mount to provide pivoting, or may include a flange that is constrained by elastomeric rings on the front mount to provide pivoting, centering, and shock absorption. The rear mount may be split in two portions to open and permit removal of the scope body. An objective lens assembly may be slidably mounted at the objective end to absorb recoil forces.

DETAILED DESCRIPTION OF A PREFERRED EMBODIMENT

Figure 1:
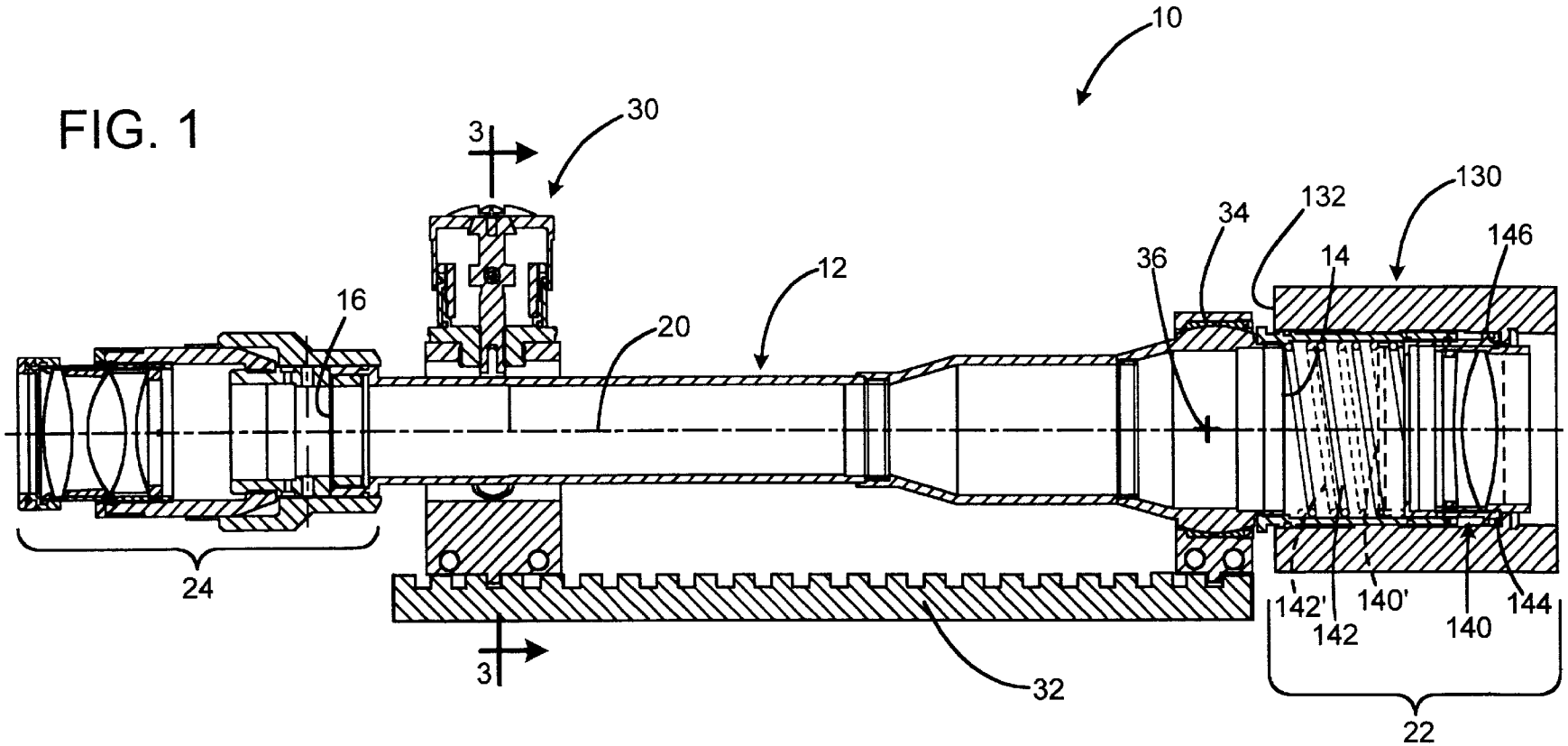
FIG. 1 is a side sectional view of a rifle scope according to a preferred embodiment of the invention.

FIG. 1 shows a rifle telescope 10, also known as a rifle scope or telescopic rifle sight. The scope includes an elongated hollow tube body 12 having a front end 14, a rear end 16, and defining an optical axis 20. An objective lens assembly 22 is connected at the front end, and an eyepiece 24 is connected at the rear end. A front mount 26 encompasses and supports a forward portion of the tube, and an adjustable rear mount 30 is spaced apart rearwardly of the front mount and encompasses and supports a rear portion of the tube. A base 32 is connected to the receiver or frame of a firearm (not shown) or other projectile emitting device, and the mounts are rigidly and removably connected to the base.

The orientation of the scope and its optical axis is adjustable with respect to the base, and therefore to the bore axis of the firearm. The tube pivots at the front mount, and is shifted laterally and vertically in the rear mount. The front pivot function may be provided in several ways. In the preferred embodiment illustrated in FIG. 1, the front end of the scope tube 12 has a ball portion 34 that has a spherical surface that encircles the tube, and which has a radius centered on the scope axis at point 36. The ball portion has the shape of the exterior of a domed ring, with the curvature in all directions being the same to provide sphericity.

Figure 2:
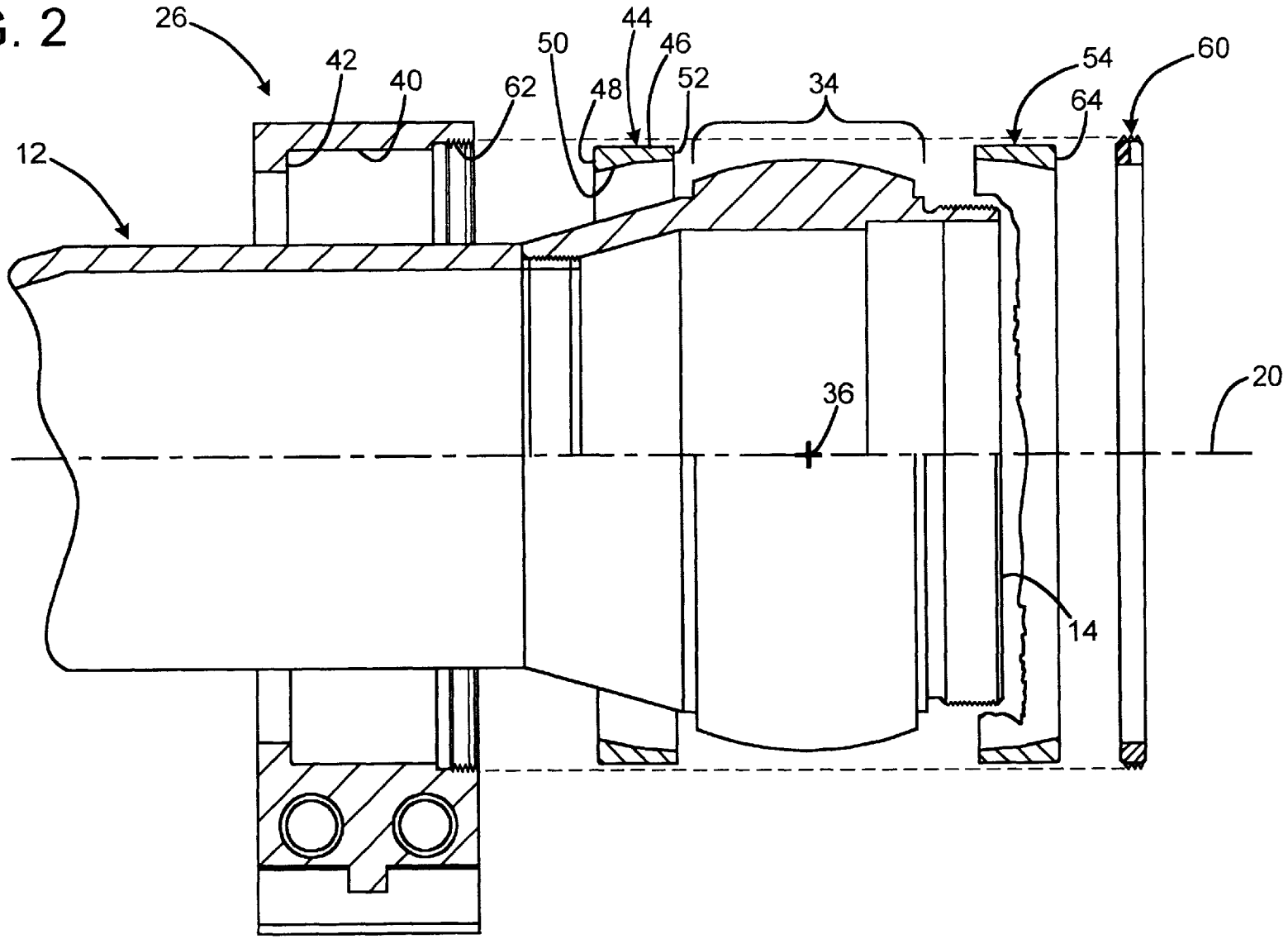
FIG. 2 is a sectional side exploded view of a front pivot portion of the rifle scope of FIG. 1.

As shown in FIG. 2, the front mount 26 defines a cylindrical bore 40 with a rear shoulder 42. A first bearing ring 44 has an outer cylindrical surface 46 sized to be closely received in the front mount bore 40, and has a flat annular rear surface 48 that rests against the shoulder 42 when installed as shown in FIG. 1. The ring has an interior surface 50 having a concave spherical radius the same as that of the ball portion. A front edge surface 52 is narrower than the rear surface due to the taper of the interior spherical surface 50.

Figure 3:
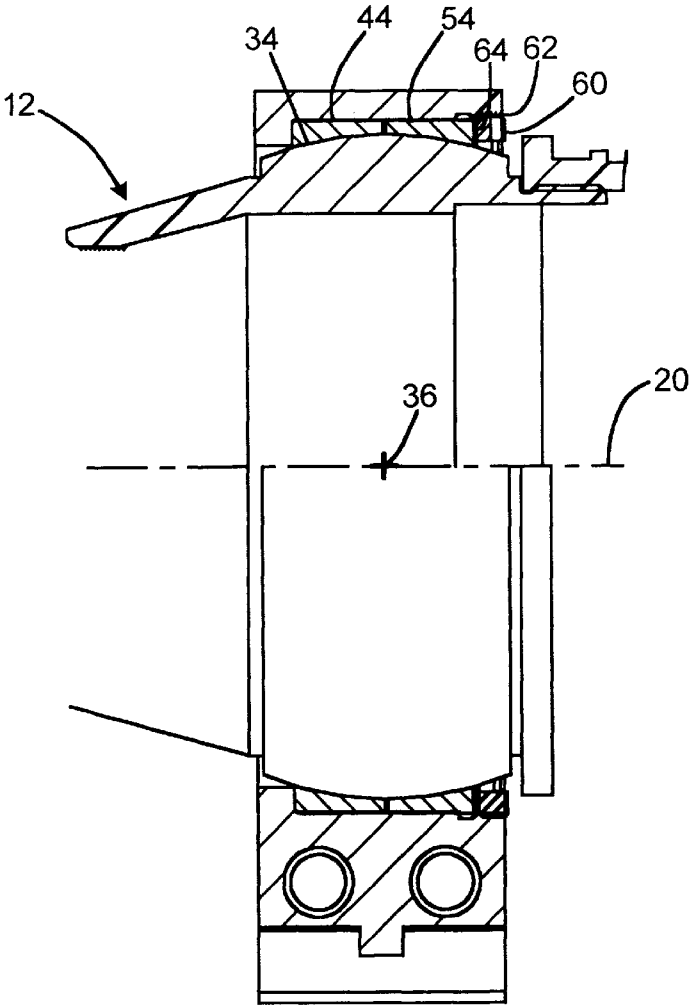
FIG. 3 is an enlarged sectional view of the embodiment of FIG. 1.

A second bearing ring 54 is identical to the first, except that it is oriented in a mirror image to the first. Thus, when slightly spaced apart, the interior bores of the rings define a common spherical surface centered on the ball's center point 34. When assembled as shown in FIG. 3, a threaded ring 60 is screwed into a threaded portion 62 of the mount 26, and provides adjustable compression against the wide forward-facing surface 64 of ring 54, which generates rearward axial force on the ball 34 to press it into ring 44, which is biased against the mount. Screwing the ring 60 tighter into the mount tends to generate a wedging effect that increases radial pressure of the rings against the ball, This adjustable tightness limits the amount of flexure under rifle recoil, and allows the friction that resists pivoting to be controlled.

In the preferred embodiment, the rings 44, 54 are formed of a low friction rigid thermoplastic such as Nylon, PTFE or Deirin. In alternative embodiments, they may be formed of elastomeric material such as rubber, or a rigid metal material if a lubricating grease is used to avoid binding. All the other structural parts in the mount and scope are formed of aluminum, with certain threaded fasteners formed of steel. In the preferred embodiment, for a scope with a tube diameter of 30 millimeters and an objective lens aperture of 44 millimeters, the ball section has a diameter of 2.30 inches, and a width of 0.86 inches.

In alternative embodiments, the front mount ball need not encircle the entire tube, since the tube does not need to be free to rotate. Because four points are the minimum to define a spherical surface, the ball only need have limited areas with sphericity, and the support rings may provide much more limited contact if desired. The theoretical limit would be to provide four small spherical areas on either the ball or the socket, and four contact points on the other element that ride on the areas, which would be sized based on the pivot angle of adjustment desired. One option with less contact area than the preferred embodiment would have O-rings without the concave spherical surfaces, to generate two lines or narrow bands of contact, instead of the broader bands of contact. Another variant may employ three or more extended spherical bearing surfaces, distributed about the diameter of the tube at the ball location.

Figure 4B:
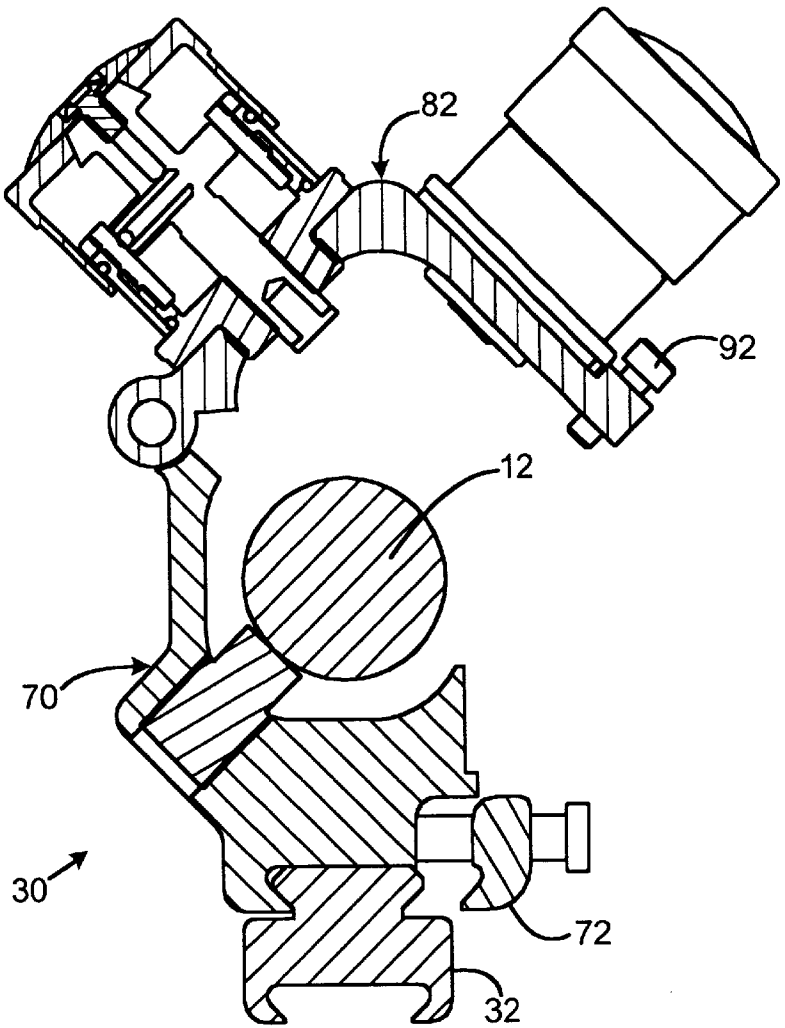
FIGS. 4A and 4B are sectional end views of a rear mount portion of the rifle scope of FIG. 1 taken along line 3—3.
Figure 4A:
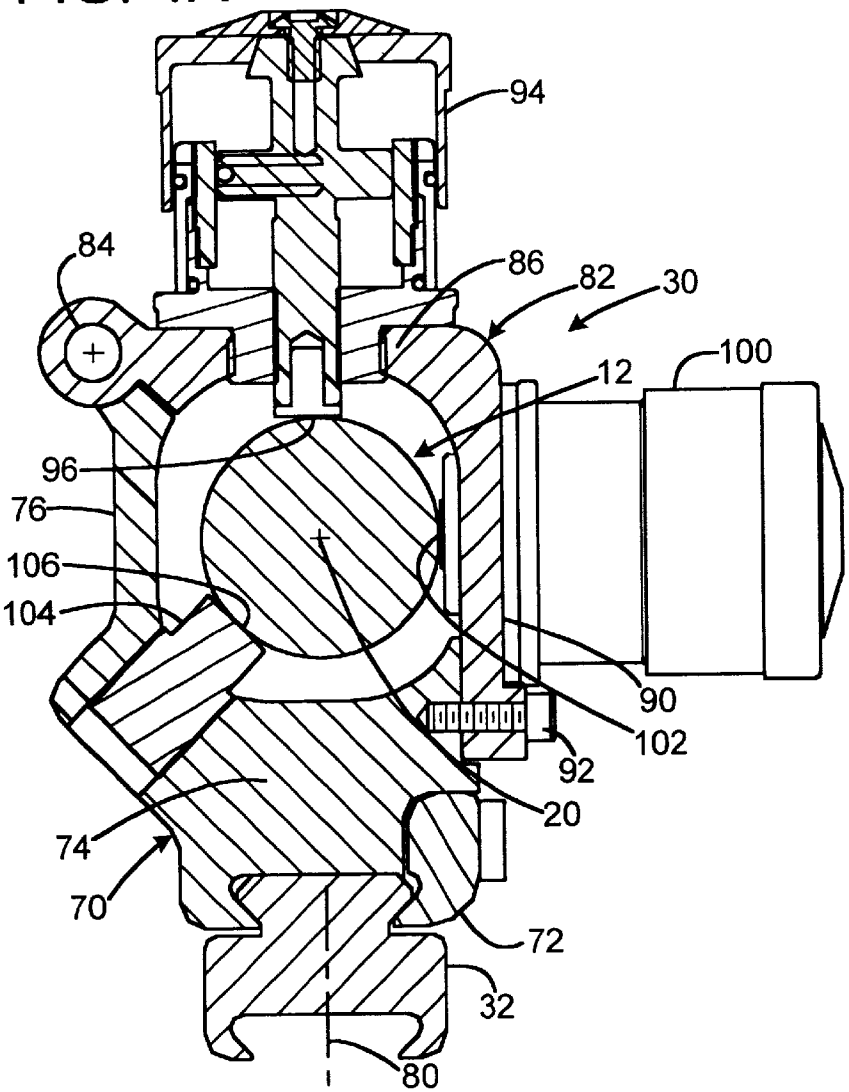

FIG. 4A shows the rear mount 30 in a closed position, encompassing the scope tube 12, and establishing its position. The mount includes a fixed portion 70 that connects to the base 32 in conjunction with a clamp 72 that is removably fastened to the base in a conventional manner. The fixed portion has a base segment 74 with an upstanding side wall 76 that is laterally spaced apart from the centerline 80 of the base, and the axis 20 of the scope tube 12. A pivoting mount portion 82 is pivotally connected to a hinge pin 84 at the upper end of the side wall 76. The pivoting portion 82 includes an upper wall 86 and a downwardly depending side wall 90 that is spaced apart from the side wall 76. The lower end of the side wall 90 defines fastener holes that allow a pair of screws 92 to secure the free end of the pivot portion to the base portion.

The upper wall 86 of the pivot portion supports an elevation adjustment knob 94 oriented vertically, and which has a screw with a lower contact surface 96 that limits the vertical position of the scope tube. Rotation of the knob adjusts the amount by which the screw's contact surface protrudes into the passage defined by the mount. The side wall 90 of the pivot portion supports a windage adjustment knob 100 oriented horizontally and perpendicularly to the optical axis 20, and which has a screw with a contact surface 102 that limits the lateral position of the scope tube. A spring biased piston 104 has a contact surface 106 facing diagonally upward toward both knob screw tips, so that the tub is biased against the screws regardless of the knob settings.

The rear mount 30 may be opened to the open position shown in FIG. 4B by removing or loosening screws 92, and pivoting the pivoting portion 82 upward to open the passage, and to allow the tube 12 to be laterally removed. The front mount should accommodate the significant angular shift required, so that the rear end of the scope may be shifted enough so that the eyepiece may bypass the rear mount elements, and so that the scope can be passed forward through the front mount after the front retaining ring has been removed. In alternative embodiments, the scope eyepiece may be removable to allow the rear end of the tube to pass through the rear mount, and to reduce the amount by which the rear end must be shifted to bypass the rear mount. The ability to open the rear mount also facilitates easy cleaning of the scope tube and knob contact where they contact each other, to remove any debris that may accumulate and undesirably shift the point of aim. The openable rear mount also allows the rear mount to be interchanged with a different rear mount without removal of the scope tube or front mount from the rifle. This is useful when the user wishes to change the type of adjustment knobs, such as to employ a different angular adjustment amount for each rotational click. Some shooting situations are better suited to larger angular shifts per click, while others such as competition where time pressure is not a factor are better suited to finer shifts per click.

Figure 5:
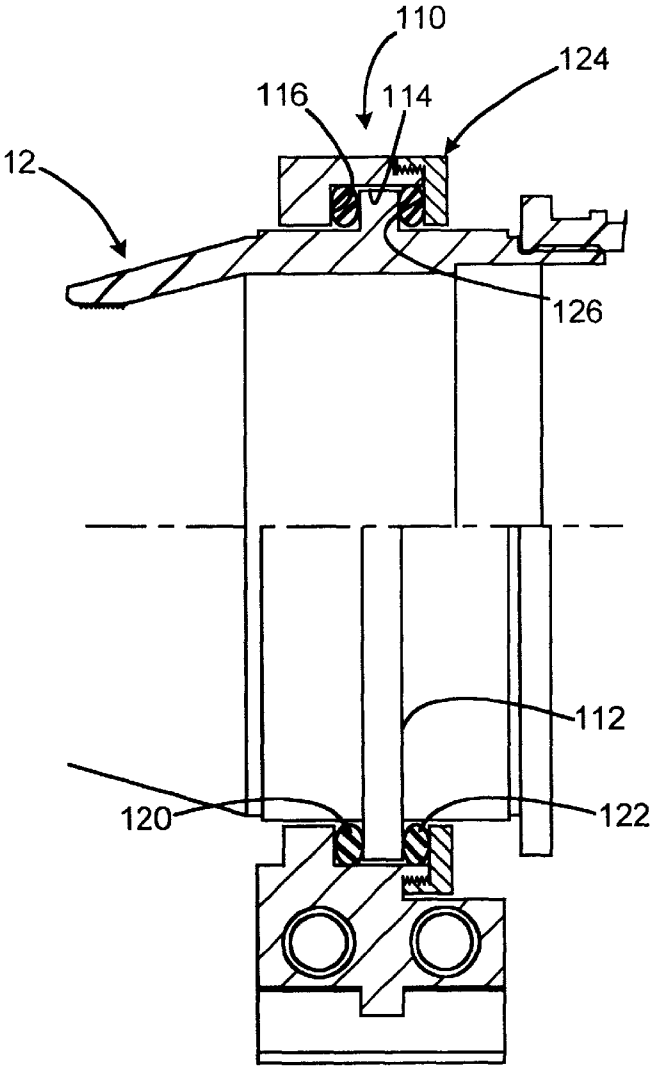
FIG. 5 is an enlarged sectional view of an alternative embodiment of the invention.

FIG. 5 shows an alternative front mount 110 in which the scope tube 12 has a protruding flange 112 at the location of the ball in the preferred embodiment. The mount defines an interior bore surface 114 with a rear shoulder surface 116. An elastomeric O-ring 120 tightly surrounds the scope tube adjacent to the flange, abuts the shoulder surface 116 and is closely received in the bore. Thus, the O-ring provides centering of the tube within the mount, and limits rearward excursion of the tube with respect to the mount. A front elastomeric O-ring 122 is positioned forward of the flange, and provided similar centering. A threaded retaining ring 124 has a shoulder surface 126 facing the front O-ring 122. The retaining ring is adjusted to compress the O-rings within the bore, so that the axial position of the tube is established when no axial force acts on it.

The elastomeric O-rings provide compressibility that allows the rear end of the tube to be shifted laterally and or vertically, without any looseness that would reduce accuracy and repeatability. Moreover, the forces are balanced, as (for example when lowering the rear end of the scope) the upper portion of the rear O-ring compresses as the lower portion of the front ring compresses. The rings continue to provide centering, and the pre-loaded compression of the rings by the retaining ring may be adequate to maintain contact of the O-ring with both the flange and the shoulder, even where the flange-shoulder separation is maximized. In addition, the elastomeric O-ring embodiment provides some recoil shock absorption without the complexity of sliding spring-buffered scopes. In the preferred embodiment, the O-rings have an outside diameter of 2.32 inches, and a thickness of 0.187 inches. As assembled, the nominal radial gap between the tube and the mount bore interior is 0.16 inches, providing an interference fit of 0.027 inches that generates compression of the O-rings. The rings are compressed axially by 0.012 inches compared to their relaxed thicknesses. With a scope deflection of 75 arc minutes, a limit established in the preferred embodiment that may readily be exceeded for different applications, the maximum compression of any O-ring portion is 20%. In the preferred embodiment, the O-rings are formed of silicone, although any other elastomer may be used.

Figure 6:
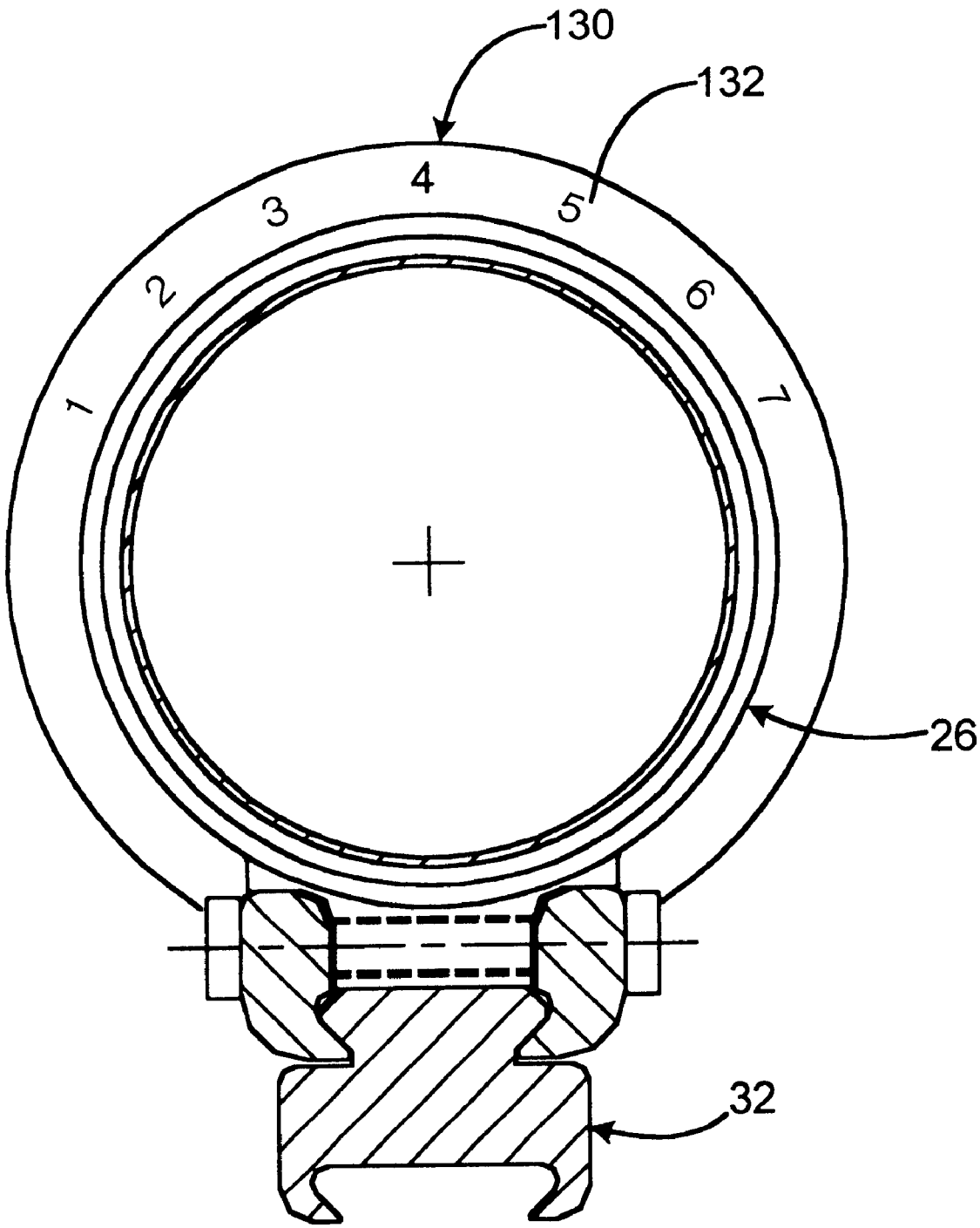
FIG. 6 is an axial sectional view of the embodiment of FIG. 1.

Referring back to FIG. 1, the objective 22 includes an outer housing 130 having an planar, annular rear face 132 facing toward the eyepiece, perpendicular to the axis of the scope. This face is marked with indicia readily visible to a user with one eye at the eyepiece, either viewing with the primary eyepiece eye shifted to see the face, or by opening the secondary eye. The housing 130 is operably connected to the objective lens focusing facility, to move the lens axially upon housing rotation to focus the lens at a selected distance, providing a sharp image and minimizing parallax errors. The indicia, as also shown in FIG. 6, are numeric markings indicating the distance at which the lens is focused. The rear face 132 has an outer diameter that is sufficiently larger that the outer diameter or profile of the front mount, particularly an upper portion of the mount 26, so that the user may view the indicia nearly on axis without obstruction by the front mount.

In addition, an internal objective lens assembly 140 is suspended within the housing for recoil accommodation. A spring 142 connected to the fixed housing is connected to the lens assembly to permit limited rearward axial movement of the assembly with respect to the scope body. The lens assembly housing has a flange 144 that normally abuts a shoulder 146 of the tube when at rest. Immediately upon firing a shot, the rifle and scope tube recoil together with the lens assembly, because the shoulder forces the flange rearward. Momentarily, when the rifle stops recoiling due to the resistance of the shooter's shoulder, the lens assembly continues rearward, compressing the spring 142 to a compressed condition 142' in which the assembly is at a rearward position 140'. In response to the compression, the spring returns the lens assembly to its rest position each time for repeatable accuracy. The spring effectively reduces the shock or momentary force that the lens would experience by extending over a larger time period, thus increasing durability and reducing the possibility of optical misalignment or damage due to excessive forces. This is useful in rifles that experience strong recoil forces in both axial directions.

While the above is discussed in terms of preferred and alternative embodiments, the invention is not intended to be so limited.

What is claimed is:

1. A rifle telescope comprising:

a scope body having an objective end and an eyepiece end;

a front mount and a rear mount spaced apart from each other, each connected to the scope body, with the front mount connected more proximate to the objective end, and the rear mount connected more proximate to the eyepiece end;

the scope body being axially fixed to the front mount;

the scope body being pivotally connected to the front mount;

the rear mount including an adjustable suspension operable to establish a selected vertical and horizontal position of the scope body portion received within the rear mount the scope body including a ball portion received by the front mount;

the front mount having a socket portion for closely receiving the ball portion;

the socket portion including a pair of rings defining interior bores with diameters less than that of the ball portion, and wherein the rings are adjustably spaced to provide a selectable compression of the ball portion.

2. The rifle telescope of claim 1 wherein including an objective lens assembly connected at the objective end of the scope body, and suspended for axial reciprocation with respect to the scope body in response to an axial recoil force.

3. The rifle telescope of claim 2 including a recoil spring operably connected to the scope body and to the objective lens assembly.

4. The rifle telescope of claim 1 wherein the rear mount includes a first portion having a base mount portion operable to connect to a rifle, and a rigid second portion pivotally connected to the first portion for motion between a closed position in which the scope body is secured within a passage defined by the first and second portions, and an open position in which the scope body may be removed from the rear mount.

5. The rifle telescope of claim 4 wherein one of the first and second portions of the rear mount includes a spring element biased toward the axis of the scope body, and the other of the first and second portions of the rear mount includes a vertical adjustment screw and a horizontal adjustment screw, each having a contact point facing the axis of the scope body, such that the spring element biases the scope body against the contacts points when the rear mount is in the closed position.

6. The rifle telescope of claim 1 wherein the portion of the scope rearward of the front mount has a maximum outside diameter less than the diameter of an aperture defined by the front mount.

7. The rifle telescope of claim 1 wherein the scope body includes a lateral protrusion protruding laterally with respect to the scope body axis, the lateral protrusion received by the front mount, and wherein the front mount includes an elastomeric element forward of the protrusion, and an elastomeric element rearward of the protrusion.

8. The rifle telescope of claim 7 wherein the protrusion is a flange encircling the scope body, and the elastomeric element are rings.

9. The rifle telescope of claim 7 wherein the scope body includes a support surface adjacent to the protrusion and encircling the scope body, and the front mount includes an inner bore surface concentric with the support surface, and wherein at least one of the elastomeric elements is a ring compressibly received between the support surface and the inner bore surface.

10. The rifle telescope of claim 1 including an objective lens housing connected at the objective end and having a flat rearward facing surface having a selected diameter and imprinted with indicia, the front mount having an exterior profile smaller than the flat rearward surface, such that at least some of the indicia is visible from the rear end.

11. A rifle telescope comprising:

a scope body having an objective end and an eyepiece end;

a front mount and a rear mount spaced apart from each other, each connected to the scope body, with the front mount connected more proximate to the objective end, and the rear mount connected more proximate to the eyepiece end;

the scope body being pivotally connected to the front mount;

the rear mount including an adjustable suspension operable to establish a selected vertical and horizontal position of the scope body portion received within the rear mount; and the rear mount including a first portion having a base mount portion operable to connect to a rifle, and a rigid second portion pivotally connected to the first portion for motion between a closed position in which the scope body is secured within a passage defined by the first and second portions, and an open position in which the scope body may be removed from the rear mount.

12. The rifle telescope of claim 11 wherein one of the first and second portions of the rear mount includes a spring element biased toward the axis of the scope body, and the other of the first and second portions of the rear mount includes a vertical adjustment screw and a horizontal adjustment screw, each having a contact point facing the axis of the scope body, such that the spring element biases the scope body against the contacts points when the rear mount is in the closed position.

13. A rifle telescope comprising:

a scope body having an objective end and an eyepiece end;

a front mount and a rear mount spaced apart from each other, each connected to the scope body, with the front mount connected more proximate to the objective end, and the rear mount connected more proximate to the eyepiece end;

the scope body being axially fixed to the front mount;

the scope body being pivotally connected to the front mount;

the rear mount including an adjustable suspension operable to establish a selected vertical and horizontal position of the scope body portion received within the rear mount; and an objective lens assembly connected at the objective end of the scope body, and suspended for axial reciprocation with respect to the scope body in response to an axial recoil force.

14. The rifle telescope of claim 13 including a recoil spring operably connected to the scope body and to the objective lens assembly.

15. A rifle telescope comprising:

a scope body having an objective end and an eyepiece end;

a front mount and a rear mount spaced apart from each other, each connected to the scope body, with the front mount connected more proximate to the objective end, and the rear mount connected more proximate to the eyepiece end;

the scope body being axially fixed to the front mount;

the scope body being pivotally connected to the front mount;

the rear mount including an adjustable suspension operable to establish a selected vertical and horizontal position of the scope body portion received within the rear mount; and wherein the scope body includes a lateral protrusion protruding laterally with respect to the scope body axis, the lateral protrusion received by the front mount, and wherein the front mount includes an elastomeric element forward of the protrusion, and an elastomeric element rearward of the protrusion.

16. The rifle telescope of claim 15 wherein the protrusion is a flange encircling the scope body, and the elastomeric element are rings.

17. The rifle telescope of claim 15 wherein the scope body includes a support surface adjacent to the protrusion and encircling the scope body, and the front mount includes an inner bore surface concentric with the support surface, and wherein at least one of the elastomeric elements is a ring compressibly received between the support surface and the inner bore surface.

* * * * *